US005253815A

United States Patent [19]

Bowns et al.

[11] Patent Number: 5,253,815

[45] Date of Patent: Oct. 19, 1993

[54] FIBERIZING APPARATUS

[75] Inventors: Mark W. Bowns, Auburn; Fred E. Olmstead, Federal Way; Peter A. Graef, Tacoma; Clifford R. Bolstad, Milton, all of Wash.

[73] Assignee: Weyerhaeuser Company, Tacoma, Wash.

[21] Appl. No.: 607,312

[22] Filed: Oct. 31, 1990

[51] Int. Cl.[5] ..... B02C 13/04; B02C 13/12

[52] U.S. Cl. ..... 241/186.1; 241/191; 241/194; 241/195; 241/292.1

[58] Field of Search ..... 241/186.1, 186.2, 189 R, 241/292.1, 195, 166, 189.1, 191, 194

[56] References Cited

U.S. PATENT DOCUMENTS

| | | | |
|---|---|---|---|
| 2,953,307 | 9/1960 | Lykken et al. | 241/191 X |
| 3,208,676 | 9/1965 | Jensen | 241/194 X |
| 3,440,135 | 4/1969 | Chung | 162/157 |
| 3,482,788 | 12/1969 | Newell | 241/194 X |
| 3,519,211 | 7/1970 | Sakulich et al. . | |
| 3,637,146 | 1/1972 | Banks | 241/194 |
| 3,750,962 | 8/1973 | Morgan. Jr. | 241/18 |
| 3,825,194 | 7/1974 | Buell | 241/191 |
| 3,966,126 | 6/1976 | Werner | 241/18 |
| 3,987,968 | 10/1976 | Moore et al. | 241/28 |
| 4,056,232 | 11/1977 | Lunnery et al. | 241/194 |
| 4,241,881 | 12/1980 | Laumer | 241/28 |
| 4,252,279 | 3/1981 | Johansson et al. | 241/27 |
| 4,406,415 | 9/1983 | Greer | 241/194 |
| 4,533,507 | 8/1985 | Tao | 261/153 |
| 4,572,440 | 2/1986 | Tao | 241/23 |
| 4,650,127 | 3/1987 | Radwanski et al. | 241/28 |
| 4,729,516 | 3/1988 | Williams, Jr. | 241/189 R X |

FOREIGN PATENT DOCUMENTS

| | | | |
|---|---|---|---|
| 0190634 | 8/1986 | European Pat. Off. . | |
| 0225940 | 6/1987 | European Pat. Off. . | |
| 0399564 | 5/1990 | European Pat. Off. . | |
| 2902257 | 7/1980 | Fed. Rep. of Germany | 241/194 |
| 159148 | 2/1983 | German Democratic Rep. | 241/195 |
| 93769 | 2/1959 | Norway | 241/292.1 |
| WO84/00904 | 3/1984 | PCT Int'l Appl. . | |
| 950432 | 8/1982 | U.S.S.R. | 241/195 |
| 1183457 | 3/1970 | United Kingdom . | |

OTHER PUBLICATIONS

American Society of Agricultural Engineers, ASAE publication 10-81, *Forest Regeneration*, 108-117, (Mar. 1981).

*Primary Examiner*—Mark Rosenbaum
*Assistant Examiner*—Frances Chin
*Attorney, Agent, or Firm*—Klarquist, Sparkman, Campbell, Leigh & Whinston

[57] ABSTRACT

A fiberizer is described having a rotor to which plural hammers are mounted for fiberizing a sheet of fibers delivered to the rotor as the rotor is rotated. A feed mechanism utilizing a pair of seal rollers, at least one of which is driven, is configured for effective delivery of both wet or dry sheets to the fiberizer. The hammers are configured to minimize dead spaces within the fiberizer. In addition, air flow is directed through the fiberizer to minimize accumulations of fibers therein. Furthermore, an optional liquid flushing mechanism is provided for periodically cleaning the fiberizer during use.

31 Claims, 5 Drawing Sheets

160
156
152
137
168
136
36
168
160
90
142
144
140
146
170
148
130
166
172
164
132
174
176
160
154
150
178
180
168
134
36
168
160

FIBERIZING APPARATUS

BACKGROUND OF THE INVENTION

This invention relates to fiberizing apparatuses and more particularly to fiberizing apparatuses which are capable of fiberizing wet or dry mats of fibers, such as wood pulp sheets or mats.

Fiberizing apparatuses exist for fiberizing wet or dry pulp mats.

A first type of known fiberizing apparatus uses a high speed propeller blade type device within an enclosed housing for fiberizing pulp mats. An example of such an apparatus is disclosed by U.S. Pat. No. 3,987,968. In a propeller type system there are a limited number of active fiberizing surfaces. This limited capability reduces the capacity of the fiberizer and makes the processing of multiple pulp mats impractical.

Another type of fiberizing apparatus employs a sawtooth shaped ripping blade helically mounted to the surface of a rotating cylinder. As a pulp mat is fed into the surface formed by the rotating blade, the blade progressively rips off fibers from the advancing mat. This apparatus suffers from the drawbacks of tearing the mat into large chunks which can wrap around the rotor. In addition, the teeth of this type of fiberizer tend to become filled with fibers, thus reducing its fiberizing capabilities.

In addition, known fiberizers or comminution machinery, when used to fiberize sheets treated with a crosslinking agent, result in the production of an excessive number of nits. Any curing of the crosslinking agent which occurs before the fibers are fiberized would cause interfiber bonding and thereby would contribute to nit formation. Such interfiber bonding would make any subsequent attempt at complete fiberization virtually impossible. Crosslinked cellulose fibers when used in many products cannot have excessive amounts of nits. Nits are hard, dense agglomerations of fibers held together by crosslinking agents due to the ability of crosslinking agents to covalently bond a number of individual fibers together. Nits can be defined as having a surface area of about 0.04 $mm^2$ to about 2.00 $mm^2$. A nit usually has a density greater than 0.8 $g/cm^3$, with a density of about 1.1 $g/cm^3$ being typical. It is virtually impossible to separate fibers comprising a nit from one another in a conventional communition device. As a result, these recalcitrant agglomerated fiber nits become incorporated into the final absorbent product where they can cause a substantial degradation of product aesthetic or functional quality. For example, nits can substantially reduce the absorbency, resiliency, and loft of an absorbent product. For aesthetically sensitive products, such as certain types of paper, the "nit level" of three or less (three or fewer nits per six-inch diameter test "hand sheet") may be regarded as a maximally acceptable number of nits. The occurrence of nits in filters using crosslinked fibers is particularly disadvantageous.

The fiberization devices (to effect "individualization" of fibers or separation of the fibers from one another) presently known to the inventors used in the prior art in connection with a fiberizing crosslink agent treated mats produce too many nits to be acceptable for many uses. This problem has been recognized in U.S. Pat. No. 3,440,135 to Chung, which discloses a process for crosslinking cellulose fibers comprising impregnating a mat of non-woven cellulose fibers and fiberizing the mat.

Chung mentions the use of conventional fiberizing devices for this purpose and recites that an excessive number of nits are produced unless a pretreatment step is utilized. In Chung, this pretreatment step is described as "aging" the fiber mats following the application of a crosslinking agent for many hours. Chung mentions that this "aging" of crosslink agent treated mats overcomes the problem of excessive nit formation. This pretreatment "aging" process is extremely impractical due to the requirement of storing rolls of the crosslink agent treated mats. Thus, the Chung patent accepts the excessive nit formation caused by prior art fiberization machinery and attempts to overcome this problem by changing processing steps prior to fiberization of the material.

Therefore, a need exists for an improved fiberizing apparatus directed toward overcoming these and other disadvantages of the prior art and in particular one which minimizes nit formation when fiberizing pretreated fibers, such as fibers pretreated with a crosslinking agent.

SUMMARY OF INVENTION

In accordance with one aspect of the present invention, a hammermill for fiberizing sheets or mats of fibers comprises a housing within which an elongated rotor is positioned. The rotor has a longitudinal axis of rotation and a plurality of hammers coupled thereto. Distal end surfaces of the hammers sweep out a path which comprises an effective rotor surface upon rotation of the rotor about the axis of rotation. The distal end surfaces of the individual hammers sweep separate cylindrical paths with gaps between the paths swept by the individual hammers. These gaps between the paths typically range from zero to no more than about one-quarter of an inch. The hammermill also includes a means for rotating the rotor about the axis of rotation to thereby rotate the hammers to provide an effective rotor surface. At least one inlet is provided through which a fiber mat is delivered to the effective rotor surface for fiberization by the rotating hammers.

As another aspect of the present invention, the rotor includes an elongated central body, the hammer being mounted to the body with the hammers arranged in plural rows, the rows extending in a direction along the length of the body. Each row in this arrangement includes plural hammer populated regions spaced apart by a hammer free or hammer unpopulated region. Each hammer populated region comprises a stack of plural spaced apart hammers projecting in a radially outward direction relative to the body. In one specific arrangement, the gaps between the individual hammers of the stack are no more than about one-quarter of an inch. Furthermore, the hammer populated and hammer free regions are offset from one another in the different rows such that at least one hammer populated region sweeps through each portion of the effective rotor surface upon rotation of the rotor.

As a more specific feature of the present invention, the hammer populated regions of each row may be aligned with a hammer free region of an adjacent row.

As a further more specific feature of the present invention, in a preferred embodiment there are sixteen rows of hammers about the circumference of the central body.

As another specific feature of an embodiment of the present invention, each row of hammers may be positioned in a line parallel to the axis of rotation of the central body.

The hammermill may, in accordance with a further aspect of the present invention, include plural spaced apart hammer mounting plates which project radially outwardly from the central body. These hammer mounting plates terminate in an exposed edge surface. The stacks of hammers may be mounted to the hammer mounting plates with the distal ends of the hammers adjacent to selected hammer mounting plates being shaped to overhang the edge surface of such selected hammer mounting plates, thereby minimizing gaps in the effective rotor surface at the location of the hammer mounting plates. The stacks of hammers may each be mounted between a respective pair of such mounting plates.

As yet another feature of the present invention, plural interior hammer mounting plates are included and spaced inwardly from the respective ends of the central body. In addition, first and second end mounting or dial plates are positioned at the respective ends of the central body. The end mounting plates are designed to extend radially outwardly from the central body to a location which is beyond the radial outwardmost position of the distal end surfaces of the hammers. These end mounting plates direct air flow within the housing from the ends of the rotor toward the center of the rotor. In this case, fibers freed from the mat are directed toward the central region of the effective hammer surface so as to minimize the possible accumulation of such fibers beyond the ends of the rotor. In this construction, the interior mounting plates may each terminate with an exposed end surface at a location which is spaced radially inwardly from the effective rotor surface.

The stacks of hammers may be configured to comprise plural central planar plates of uniform cross-sectioned with end hammers of the stacks being plates of an L-shaped cross-section. The end hammers may have a radially extending leg portion and a transversely extending lip portion. The lip portion of each of the end hammers overhangs at least a portion of the exposed edge surface of the adjacent interior mounting plate so as to minimize any gap in the effective rotor surface at such locations.

As yet another aspect of the present invention, the hammermill may comprise a pair of feed rollers with the fiber mat received therebetween. Each such feed roller typically has a longitudinal axis parallel to the longitudinal axis of rotation of the rotor. At least one of the feed rollers is preferably driven to advance the mat through the inlet and against the rotor. In a preferred form of the invention, plural mat feeder devices may be included, such as six such devices each for directing a fiber mat through an inlet and against the rotor surface. These inlets and associated mat feeders are spaced about the circumference of the housing to thereby increase the capacity of the hammermill in that plural sheets may be fiberized simultaneously. It has also been found that wet fiber mats may be fiberized by the present invention. Minimal plugging of the inlets occurs by establishing the distance between the effective rotor surface and the longitudinal axes of the feed rollers to be less than about four inches and preferably from about one-half to about four inches. This arrangement has proven particularly advantageous when mats saturated with a crosslinking material are defiberized by the apparatus.

As yet another feature of the invention, a liquid flush mechanism may be included for selectively cleaning the fiberizer with a cleaning liquid, such as water.

It is accordingly one object of the present invention to provide an improved fiberizing apparatus.

It is another object of the present invention to provide such an apparatus which minimizes the formation of nits, particularly when pretreated fiber mats are defiberized, such as fiber mats pretreated with crosslinking agents.

A still further object of the present invention is to provide an apparatus for fiberizing wet or dry fiber mats, such as cellulose fiber mats.

Yet another object of the present invention is to provide a fiberizing apparatus which minimizes clogging and unwanted fiber accumulation even when utilized to fiberize wet fiber mats.

Still another object of the present invention is to provide a fiberizer with the capacity for fiberizing fiber mats at a rapid rate and which is capable of simultaneously fiberizing multiple mats, such as multiple pulp mats.

A still further object of the present invention is to provide a wet or dry mat fiberizer which is durable and requires minimal maintenance.

The present invention relates to the above features, advantages and objects both individually and collectively. These and other advantages, features and objects of the present invention will become apparent with reference to the following description and drawings.

DETAILED DESCRIPTION OF A PREFERRED EMBODIMENT

Figure 1:
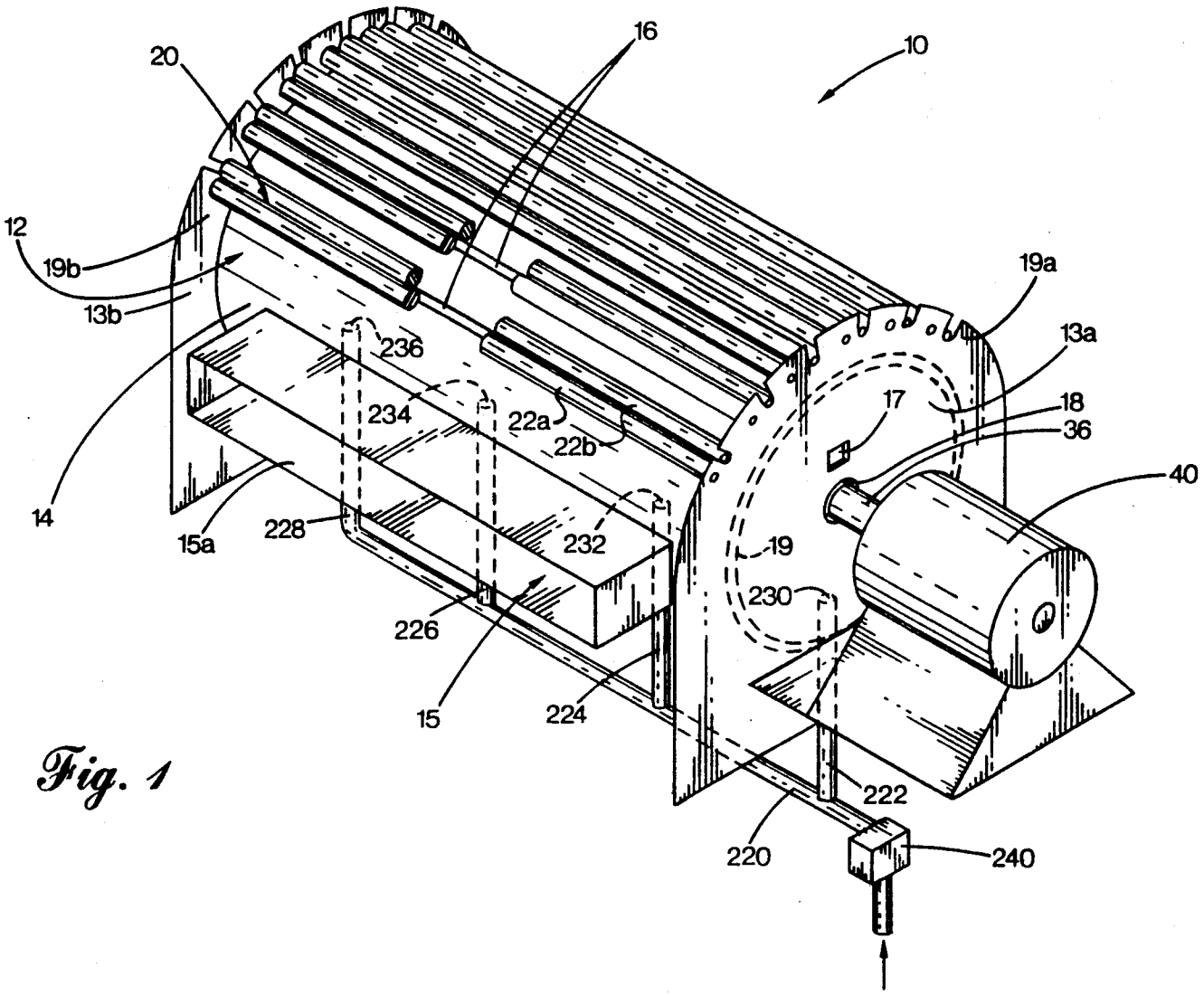
FIG. 1 is an isometric view of selected portions of an apparatus in accordance with the invention.
Figure 4:
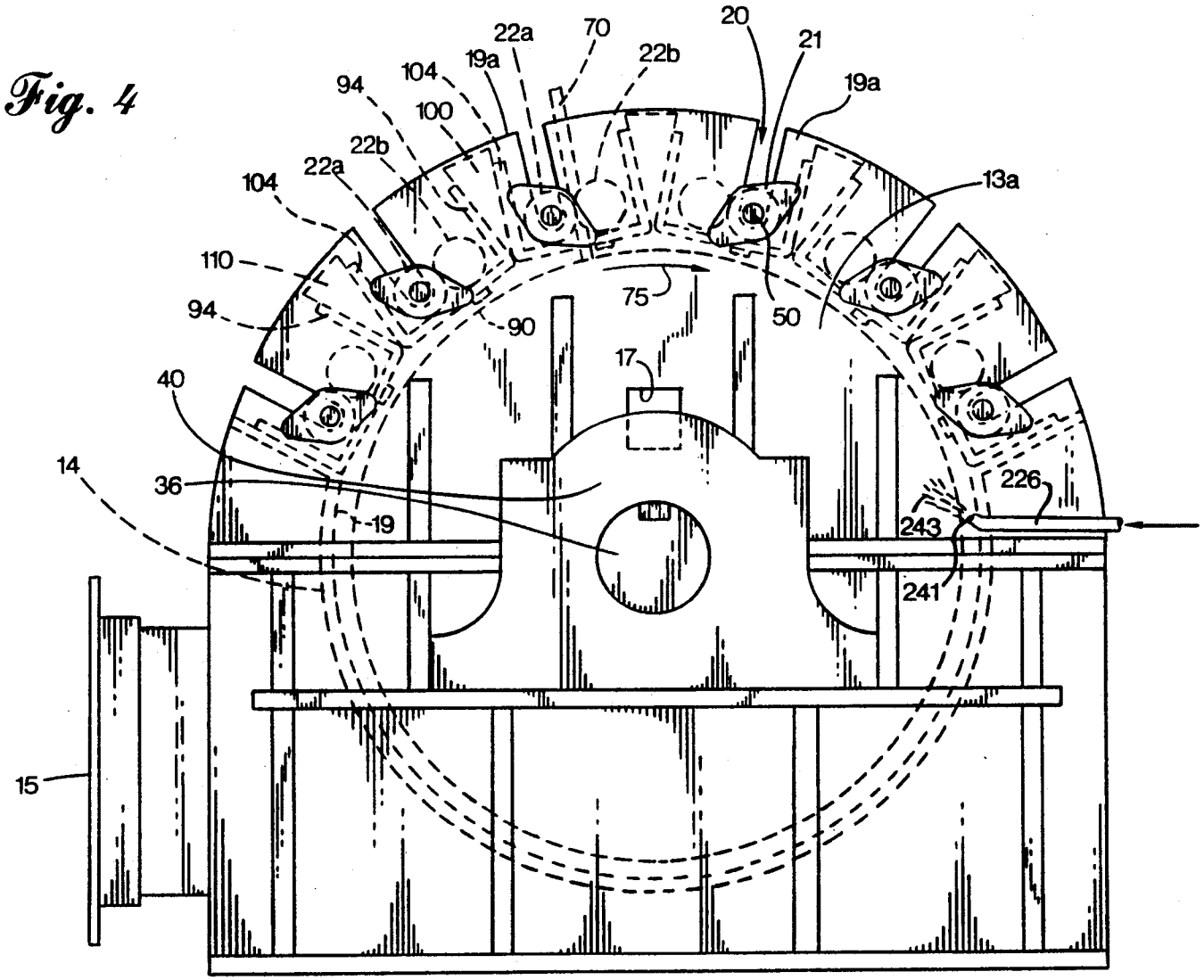
FIG. 4 a is an end elevation view of an apparatus in accordance with the invention.

Referring to the drawings, FIGS. 1 and 4 illustrate one preferred form of fiberizing apparatus 10 constructed in accordance with the invention. For purposes of convenience, this fiberizer, also known as an attrition device, will be described as a hammermill. The fiberizer 10 includes a hollow elongated cylindrical housing 12, preferably of circular cross-section, having an interior and exterior surface. The main body of the housing is formed by a wall 14 which forms the lower section of the housing 12 and feed mechanism supports (e.g. 94, 100, 104, 110 described below and shown in FIG. 4) which form the upper portion of the housing. The wall 14 and feed mechanism supports in effect define a closed cylindrical interior surface 19 (FIG. 1) of the housing. The housing may also be formed by simply extending the wall 14 such that the wall 14 is of circular cross section and forms the entire housing body. The ends of the housing are closed by respective end panels or walls 13*a*, 13*b*.

The wall 14 is provided with an elongated fiber outlet, indicated at 15, surrounded by a box-like shroud 15*a* for coupling to a conduit, not shown. Individualized fibers generated within the hammermill 10 are discharged through the outlet 15 for downstream processing. Typically, a blower, not shown, is coupled to the outlet 15 for moving fiber from this outlet to downstream collection or processing stations. An airflow inlet, one being indicated at 17, is provided through each of the respective end plates 13*a*, 13*b*. With the downstream blower in operation, air is drawn through the inlet 17 and toward the center of the hammermill by the blower. This air movement, described in greater detail below, minimizes accumulation of fibers within housing 12 adjacent to the end plates 13*a*, 13*b*. Although variable, a typical air flow through each of the openings is about 50 $m^3$/min.

The housing 12 also includes at least one, and preferably a plurality of elongated mat inlet slots 16 extending in a direction generally parallel to longitudinal axis of the housing. In the embodiment illustrated in FIG. 1, six such inlet slots are provided. As fiber mats are delivered through the respective slots 16 to the interior of housing 12, a rotating rotor, described below, engages the leading edge of the mats and fiberizes the mats into individual fibers. The rotor is driven in rotation by a motor 40 coupled by a shaft 36 of the rotor, the shaft 36 extending through an opening 18 in the end plate 13*a*. The shaft 36 is supported outside of the housing 12 for rotation with the longitudinal axis of the shaft corresponding to the longitudinal axis of housing 12 and of the interior housing surface 19.

The end panels 13*a*, 13*b* each have respective upright flange portions 19*a*, 19*b* extending beyond the outer surface of the wall 14. The extending flanges 19*a*, 19*b* provide one form of support for supporting mat feeder assemblies designed to deliver fiber mats to the respective slots 16 for fiberization within the hammermill.

Figure 2:
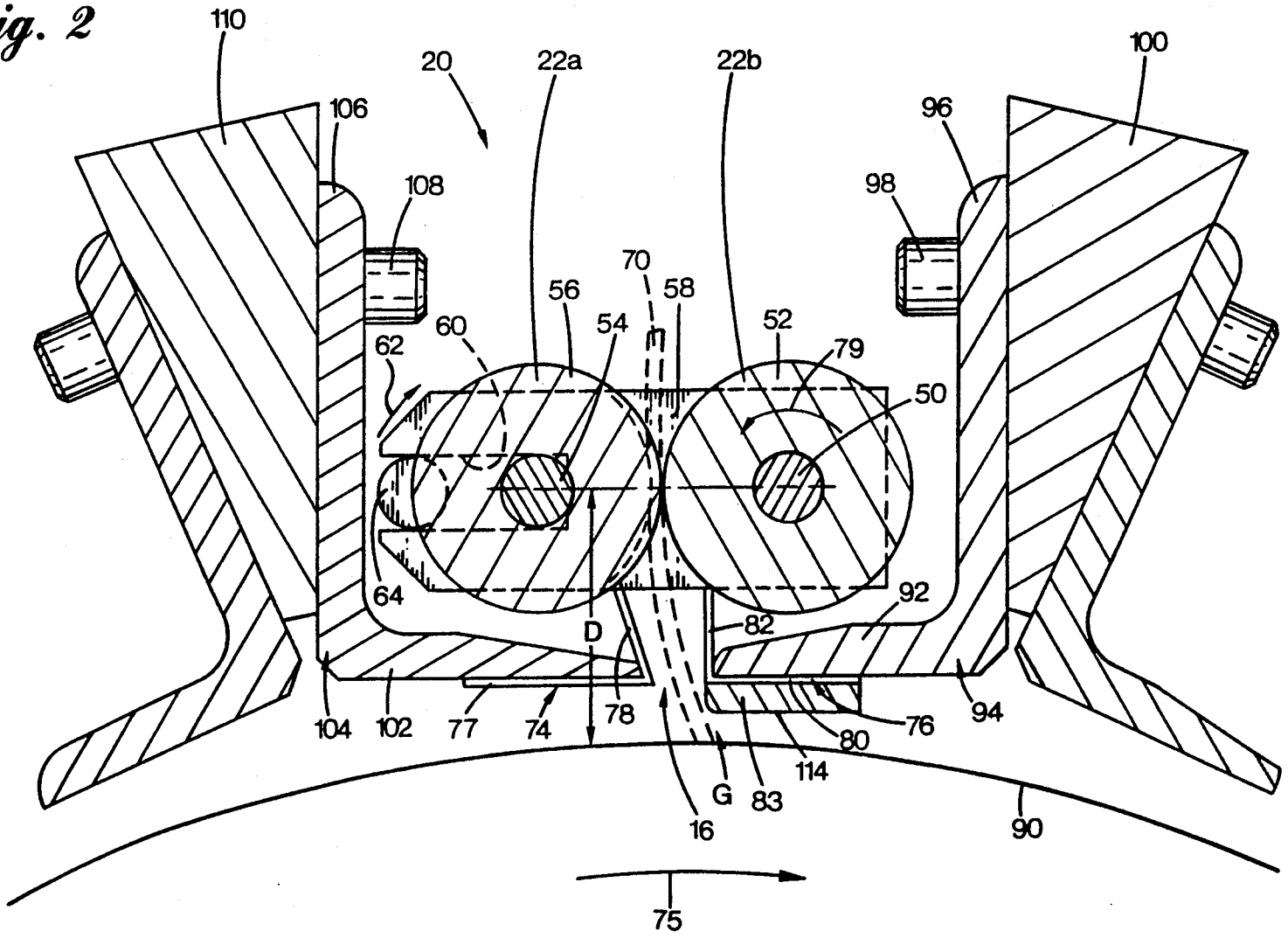
FIG. 2 is a transverse sectional view of one form of a mat feeder assembly in accordance with the present invention.

Although various types of mat feeding mechanisms may be used, one suitable mat feeder assembly is illustrated generally at 20 in FIG. 1 and comprises a pair of seal rollers 22*a*, 22*b* supported at their respective ends by the end flanges 19*a*, 19*b*. The longitudinal axes of rollers 22*a*, 22*b* are generally parallel to the associated slot 16 and to the axis of the rotor shaft 36, and thereby to the longitudinal axis of the interior cylindrical housing surface 19. The illustrated feed mechanism 20 is shown in greater detail in FIGS. 2 and 4. Although various types of rollers may be used, with reference to these figures, the illustrated seal roller 22*b* includes a central shaft 50 to which is mounted a cylindrical roll 52. Both the shaft 50 and roll 52 are typically made of a rigid material, such as steel. Similarly, the seal roller 22*a* includes a shaft 54 and roll 56. Each end of the shaft 50 is journaled by a bearing (one being numbered as 21 in FIG. 4). The ends of the shaft 54 are supported by support brackets, one being shown in FIG. 2. More specifically, as shown in FIG. 2, the bracket 58 has a shaft receiving recess 60 for receiving the associated end of the shaft 54 with the bracket (not shown) at the opposite end of the roller 22*a* being similarly constructed. The bracket 58 is pivotally coupled to the associated end plate 19*a* or 19*b* for movement in the direction of arrow 62 whenever a recess engaging bolt 64 is removed from the recess 60. This permits pivoting of the bracket 58 to an open position in which recess 60 extends in a radially outward direction and in which the seal roll 22*a* may be removed from the recess 60 for cleaning and to facilitate access to the other seal roll 22*b*.

It should be noted that FIG. 2 illustrates only one of the seal roll assemblies 20. As can be seen from FIG. 4, the assemblies are positioned in the right quadrant of this figure as shown in FIG. 2. In contrast, the assemblies, in the left quadrant of this figure reverse the positioning of the seal rollers 22*a*, 22*b* from that shown in FIG. 2. However, in each case the nose bar 83 (described below) is positioned along the side of the inlet 16 which is lagging (relative to the direction of motion of the rotor). With this arrangement, gravity assists in holding the brackets 58 and seal rollers 22*b* in the open position.

Although not shown, with the seal roller/bracket assembly in the position illustrated in FIG. 2, pneumatic cylinders apply a load to the respective ends of the shaft 54 to bias the rollers 22*a* and 22*b* against one another. Typically, a load of from about 5 psi to 80 psi is applied to each of the ends of the shaft 54 during operation of the apparatus.

In operation, the pneumatic pressure on shaft 54 is released to permit the insertion of a pulp or other fiber mat 70, shown in dashed lines in FIG. 2, between the rolls 22*a* and 22*b*. At least one of the rolls 22*a*, 22*b* is then driven to advance the pulp sheet 70 toward the gap or inlet slot 16 and then toward a rotor rotating in a direction of arrow 75 within the housing. In the illustrated embodiment, the seal roller 22*b* is the only driven roller, with this roller being driven in the direction of arrow 79 by a conventional motor not shown. This motor is typically a variable speed motor with the sheet being advanced between the rollers at a desired rate.

For a sheet of a basis weight of 680 g/$m^2$ and 52 inches wide, with a single sheet being fed to the hammermill 10, the apparatus has been tested at a feed rate of 80 lineal feet per minute. This sheet feed rate may of course be varied. Typically, when six sheets are being fed to the hammermill, the feed rate will vary from 15 feet per minute to 40 feet per minute.

After passing between the seal rollers 22*a* and 22*b*, the sheet 70 is guided by first and second guides 74 and 76 to the inlet slot 16. The guides 74 and 76 are elongated and extend generally along the full length of the slot 16. Guide 74 includes a base flange 77 and a guide leg flange 78, the guide leg flange extending from the opening of the slot 16 toward the seal roller 22*a* at an acute angle with respect to the base flange 77. A clearance gap is provided between seal roller 22*a* and the leg flange 78 so that the leg flange 78 does not interfere with rotation of the seal roller. Similarly, the guide 76 includes a base flange 80 and a leg guiding flange 82 extending from the mouth of the slot 16 toward the seal roller 22*b*. Flanges 80 and 82 are generally at a right angle with respect to one another.

An elongated nose bar 83 is positioned against the flange 76 and between the flange and the effective rotor surface 90, the effective rotor surface being the surface swept by hammers of a rotor as the rotor is rotated as explained below. The nose bar 83 and guide 76 are mounted, as by screws not shown, to a first leg 92 of an angle bracket 94 having a second leg 96 secured, as by a screw or other fastener 98 to a support bar 100. The support bar 100 extends between the flange portions 19*a* and 19*b* of the housing to thereby support the nose bar and guide 76 in position. Similarly, the guide 74 is mounted to one leg 102 of an angle bracket 104 having a second leg 106 secured by a fastener 108 to another support bar 110. Support bar 110, like bar 100, extends between the flanges 19*a* and 19*b* to support the guide 74 in position. In the same manner, the other seal rollers 22*a* and 22*b* are supported (see FIG. 4) in a proper position relative to the respective inlet slots 16 for directing fiber mats to the hammermill 10. The gap G (FIG. 2) between the effective rotor surface 90 and the adjacent surface 114 of nose bar 83 is preferably no more than about one-fourth inch, although this may be varied. Also, the nose bar 83 may be removed, in which case the gap G between the effective rotor surface 90 and the adjacent surface of support flange 80 is no more than about one-half inch. It has been found that a gap G between approximately one-fourth of an inch at the low end and about one inch or somewhat higher at the high end is suitable for fiberizing pulp sheets while minimizing the production of nits as the sheets are fiberized.

Also, it is somewhat difficult to feed wet sheets of fiber, particularly at a high rate, through the slot 16 and to the effective rotor surface 90 if the distance D between a plane containing the axes of the seal rollers 22*a*, 22*b* and the effective rotor surface 90 becomes too great. That is, as D is increased, there is a tendency of sheets 70, when wet, to plug the slot 16, especially when sheet feed rates are increased. By maintaining this distance D of from about one-half inch to no more than about four inches, this tendency for wet sheets to plug inlets 16 to the housing 12 is minimized.

From the above description, and with reference to FIGS. 2 and 4, it should apparent that if no sheet 70 is being fed between a respective pair of seal rollers 22*a* and 22*b*, then the rollers are urged together. The closing of these seal rollers effectively prevents access to the slot 16 from the exterior of the hammermill. In addition, the guides 74 and 76, and in particular guide legs 78, 82, provide a substantial degree of closure at the location of these components. Consequently, very little air is drawn into the hammermill at these locations by the downstream blower. Instead, as previously described in connection with FIG. 1, the bulk of the air entering the hammermill enters through the openings 17 (FIG. 1). This entering air again is drawn from the ends of the housing 12 toward the center of the rotor and moves fibers in this direction and away from end areas of the housing where they may otherwise tend to accumulate.

Figure 3:
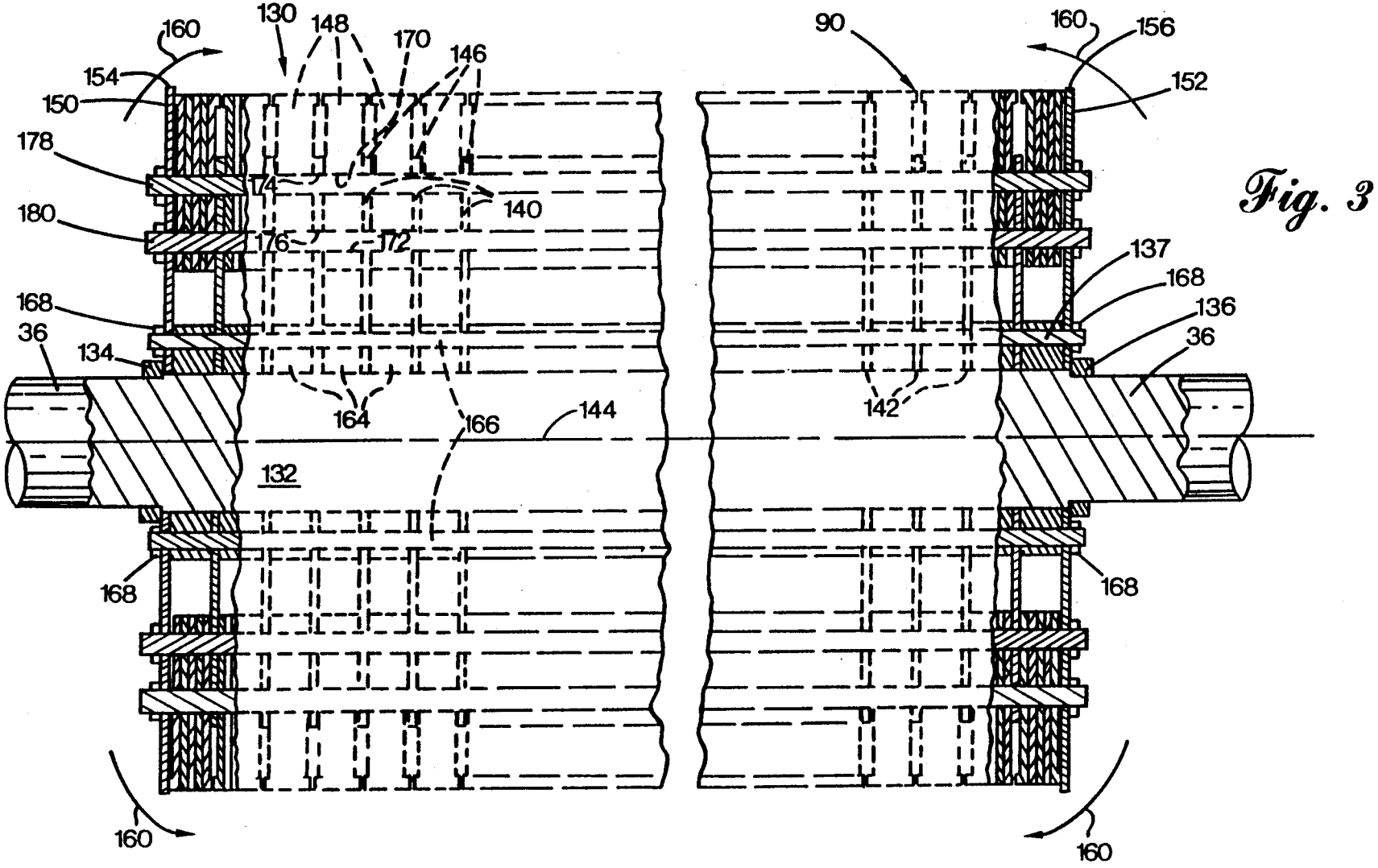
FIG. 3 is a side elevational view of a rotor assembly utilized in the apparatus of FIG. 1.
Figure 7:
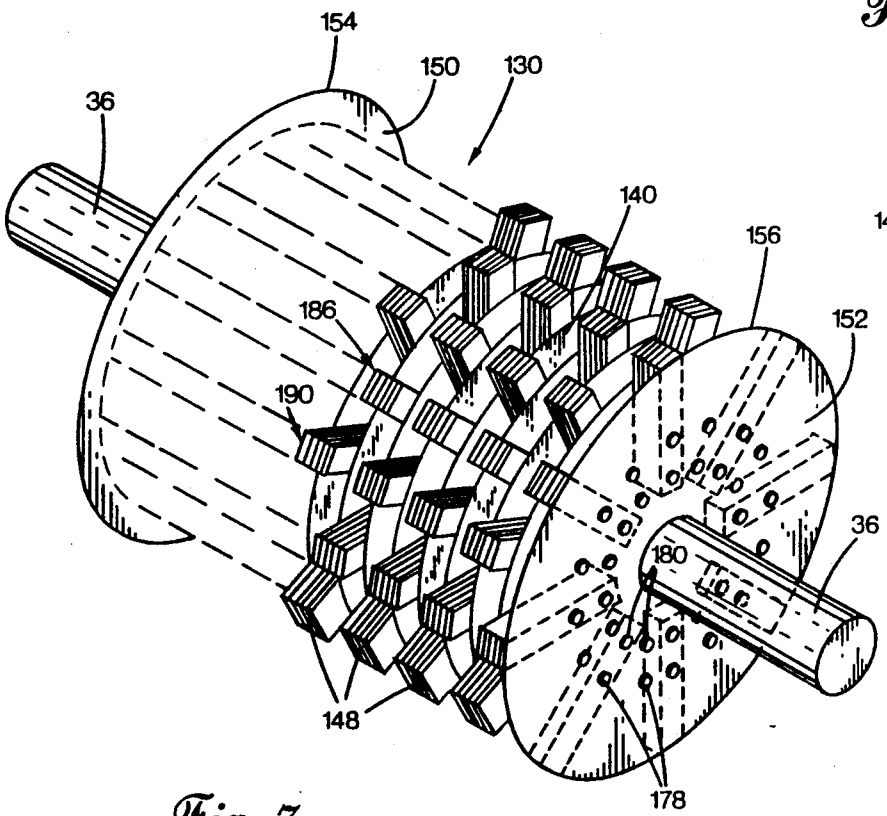
FIG. 7 is a schematic illustration of the rotor assembly of FIG. 4, showing one staggered arrangement of hammers of such assembly.

With reference to FIGS. 3 and 7, a suitable rotor 130 for the hammermill of FIG. 1 is shown. The rotor 130 has a central shaft 36 (as previously described and which is driven by the motor 40, FIG. 1). The central region of shaft 36 typically comprises an elongated central body 132, which in the illustrated form is of a greater diameter than the diameter of the shaft 36. The shaft ends 36 are supported for rotation by respective bearing assemblies to a support (not shown) and may be journaled to the respective end plates 13*a*, 13*b* (FIG. 1). As best shown in FIG. 4, a plurality of hammer mounting plates, some being numbered as 140 in this figure, are mounted to the body 132 and project radially outwardly from the body. Each of these plates has a central opening 142 sized to receive the central body 132 of the shaft 36. The mounting plates are each positioned in a plane perpendicular to the longitudinal axis 144 of the shaft 36 and are preferably parallel to one another. Furthermore, in the illustrated arrangement, the mounting plates are evenly spaced along the shaft. Selected mounting plates, and in this case the mounting plates spaced inwardly from the ends of the rotor 130, have exposed circumferential edge surfaces (some being indicated at 146) which terminate radially inwardly of the effective rotor surface 90. Again, the effective rotor surface is the surface swept by plural hammers or hammer assemblies, some being indicated at 148, during the rotation of the rotor. The hammers 148 are coupled to the body section 132, in this case by being secured to the mounting plates as explained below.

The mounting plates also include a pair of end hammer mounting or dial plates 150, 152 at the respective ends of the rotor 130. The end plate 150 extends radially outwardly beyond the effective rotor surface 90 and terminates in a circumferential edge surface 154 as shown. Similarly, the end plate 152 extends radially outwardly beyond the effective rotor surface 90 and terminates in a circumferential edge surface 156. When the rotor is mounted within the housing, the gap between the surfaces 154, 156 and the adjacent section of the housing wall 14 is typically from about one-sixteenth of an inch to about one-half of an inch. With this arrangement, the end plates 150, 152 help prevent fiber from passing beyond the end plates and into areas of the housing where the fibers may otherwise accumulate. In addition, air drawn through the openings 17 (FIG. 1) in the housing 12 tends to flow in the direction indicated generally by arrows 160 around the respective surfaces 154, 156 and toward the center of the rotor to carry fiber away from the ends of the housing.

Referring again to FIG. 3, as one approach for mounting the end plates 150, 152 and hammer mounting plates 140 in position, these plates may be mounted to the body section 132 with a respective annular spacer 164 positioned between each pair of such plates. Mounting plate securing rods 137 may then be inserted through aligned apertures in the mounting plates 140, 150, 152 and spacers 164 with these rods being secured by respective fasteners 168 to provide a rigid mounting plate assembly. In this case, the ring nut assemblies 134, 136 retain the mounting plate assembly on the central shaft portion 132. With this construction removal and replacement of the mounting plates is permitted, for example in the event one becomes damaged.

The hammers 148 are typically positioned between respective hammer mounting plates 140 with the end most hammers being positioned between one of the end plates 150, 152 and the adjacent hammer mounting plate. Although any suitable approach for mounting the hammer assemblies 140 to the shaft 132 may be used, in the illustrated embodiment the hammer assemblies are each provided with respective spaced apart apertures 170, 172. The apertures 170 are aligned with apertures 174 through the mounting plates 140 and the apertures 172 are aligned with apertures 176 through the mounting plates. A mounting rod 178 is inserted through the apertures 170 and 174 while a similar rod 180 is inserted through the apertures 172 and 176 to thereby secure the hammer assemblies 148 in place. Fasteners, such as nuts, secure the rods 178, 180 in place at the location where the rods emerge from the end plates 150, 152. The rods 178, 180 typically extend in a direction parallel to the longitudinal axis 144 of the rotor and pairs of the rods 178, 180 are also in radial alignment with one another.

As shown in FIG. 7, plural pairs or associated radially aligned sets of rods 178, 180 are arranged about the circumference of the rotor 130. In one specific form of rotor, there are sixteen pairs of rods 178, 180 spaced an equal distance about the circumference of the rotor so as to provide sixteen rows of hammer assemblies 148. Each of these rows of hammers extend in a direction parallel to the longitudinal axis of the shaft 36. For purposes of further illustration, two such rows 186, 190 are numbered as indicated in FIG. 7. Although other arrangements of hammers may be used, for the illustrated preferred embodiment the individual rows are comprised of hammer populated regions spaced from one another by a hammer free or hammer unpopulated region. Moreover, the hammers of adjacent rows are circumferentially aligned with hammer unpopulated regions of adjacent rows to provide a staggered arrangement of hammers 148.

Figure 6:
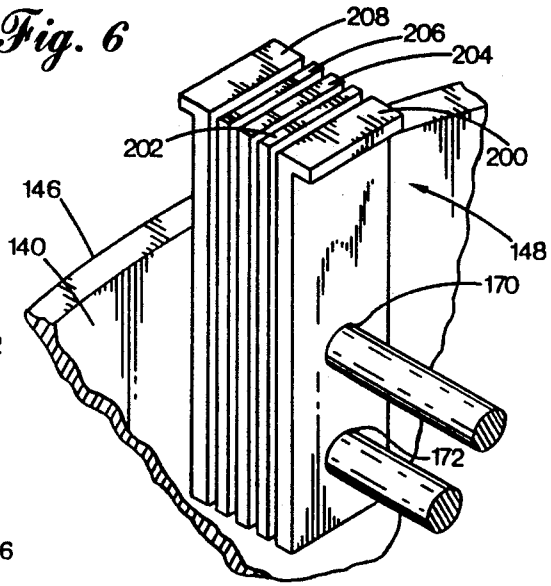
FIG. 6 is an isometric view of hammers arranged in a stack in accordance with one aspect of the present invention.
Figure 5:
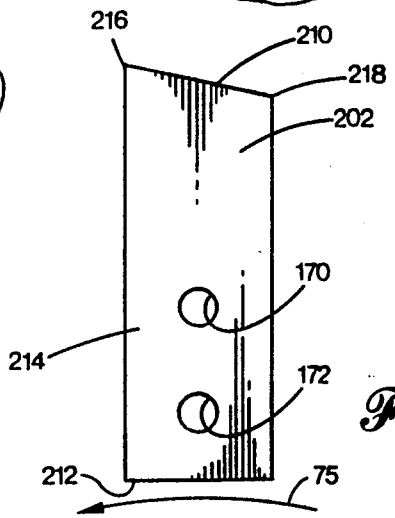
FIG. 5 is plan view of one form of hammer utilized in the present invention.

As shown in FIGS. 5 and 6, the hammers 148 of the preferred embodiment are formed by stacking a plurality of hammer plates such as plates 200, 202, 204, 206 and 208. Each of the hammer plates has a distal end with a distal end surface, indicated at 210 for the hammer plate 202 in FIG. 5, and a proximate end 212. The central portion 214 of the hammer plate defines the apertures 170, 172. As the hammer is rotated in the direction of the arrow 75 as shown in FIG. 5, the distal end surface 210 is swept in a circumferential path through the interior of the housing 12. Each of the illustrated hammer plates has a leading edge 216 and a trailing edge 218, with the leading edge leading in a circumferentially advanced position relative to the trailing edge as the rotor is rotated in its normal direction of rotation. The distal end surface 210, including the leading edge 216 and trailing edge 218, thus traces out a portion of the effective rotor surface as the rotor is rotated. More specifically, the hammer assemblies engage and break apart the fiber mats delivered to the interior of the hammermill 12 into individualized fibers. Although the specific shape and form of the hammers are variable, in the illustrated hammers, the angle between a line of in the plane of the distal end surface 210 relative to a line tangent to the circumference through which the leading edge 216 is rotated is about five degrees.

As shown in FIG. 6, the hammer assemblies 148 are installed in groups or stacks of hammer plates, each hammer assembly comprising a plurality of spaced apart individual hammer plates with five such hammer plates being a preferred example. Each hammer plate of the stack has its respective apertures 170, 172 aligned so that, when mounted in place, the hammers are correspondingly aligned. The central hammer plates of the stack 202, 204 and 206 are preferably planar as shown. In contrast, the two end hammers 200 and 208 of each stack are preferably of an L-shaped cross-section. That is, the end hammers have an enlarged distal end portion in the form of a lip or overhang which extends over the end surfaces 146 of the adjacent hammer mounting plates. This is shown for hammer 208 relative to the mounting plate 140 in FIG. 6. Typically, the overhang is such that the hammers 200 and 208 extend over about one-half of the thickness of the respective hammer mounting plates 140. Consequently, the gaps between adjacent hammer plates in the effective rotor surface, including the gaps between hammers of different stacks separated by a mounting plate 140, are minimized. Preferably, the gaps between the individual hammer plates, the gaps being established by spacers between individual hammer plates, do not exceed more than about one-fourth inch. In addition, preferably the surface swept by a stack of hammer plates is separated from other surfaces swept by adjacent stacks of hammer plates by no more than about one-fourth of an inch.

As also is best seen in FIG. 7, the stacks of hammer plates are preferably arranged in rows with the rows having half as many hammer stacks as there are spaces for such stacks between the end plates 150, 152. Thus, the hammer stacks are arranged alternately with empty spaces between the hammer stacks as previously explained. Furthermore, the stacks of hammers are similar with the exception that the stacks adjacent to the end mounting plates 150, 152 do not have overhangs adjacent to such end mounting plates as the end plates 150, 152 in the illustrated embodiment extend further in the radial direction than the distal end of the adjacent hammer. However, the end plates 150, 152 may also be configured to terminate radially short of the distal ends of the hammers if desired.

Referring again to FIG. 1, a flushing conduit 220 is shown schematically with branch conduits 222, 224, 226 and 228 coupled from the flushing conduit to respective ports 230, 232, 234 and 236 leading to the interior of the housing 12. A cleaning fluid, such as water, is selectively delivered to the conduit 220 by opening a valve 240 so as to flush the interior of the housing 12 with a cleaning fluid. By rotating the rotor using the motor 40 during such cleaning operations, the little fiber which accumulates in the hammermill during operation is flushed from the apparatus for removal. This flushing or cleaning operation may be performed periodically as desired, with once every sixteen hours of operation being one typical frequency. In the preferred embodiment, the conduits 222–228 are oriented as shown in FIG. 4 in a horizontal plane. Each conduit terminates in a nozzle orifice 241, such as a three-fourth inch orifice. The orifices are preferably directed somewhat counter to the direction 75 of rotation of the rotor. As shown in FIG. 4, water 243 leaves the orifice 241 at an angle of about thirty degrees relative to horizontal. For more effective cleaning, the number of such nozzles may be increased beyond the form shown schematically in FIG. 1.

It has been found that a fiberizer in accordance with the present invention provides an effective and efficient machine for fiberizing sheets of fiber, including sheets of wet cellulose pulp. Moreover, it has also been found that the sheets may be pretreated with a crosslinking material prior to fiberization with the fiberizer effectively fiberizing the sheets while minimizing the number of nits formed within the fiberizer. Although not limited to a particular theory of operation, it is believed that the present invention minimizes the accumulation of crosslinked material treated fibers therein. Accumulations of such fibers may be subjected to pressures and temperatures during operation of a hammermill which are high enough to cause a curing of the crosslinking agent while the fibers are in intimate contact with each other. Any such curing would result in formation of interfiber bonds, with the bonded fibers forming nits which cannot be effectively broken by downstream fiberizing equipment. Nit formation in a conventional fiberizer apparatus can also lead to the production of excessive amounts of "fines" which are undesirably short fibers caused principally by fiber breakage. Crosslinking imparts substantial brittleness to cellulose fibers, which thereby exhibit limited compliance when subjected to mechanical stresses. Nits are especially susceptible to mechanical stresses because of their density which is much greater than the density of individual fibers. Excess fines not only degrade absorbency of resulting products made therefrom, but can also substantially reduce the loft and resiliency of a product made from crosslinked fibers.

In a specific example which illustrates the use of the above described fiberizer, non-woven mats of cellulose fibers were impregnated with a crosslinking agent, and fiberized using an apparatus as described above in connection with FIGS. 1-7. In this case, a single fifty-two inch wide fibrous mat, having a calliper of 1.25 mm and a basis weight of 680 g/m$^2$ was fed at a rate of 8 m/min. to the rotor 130 (FIG. 7) utilizing a single feed apparatus as described in FIGS. 2 and 4. The mat was impregnated using dimethyloldihydroxyehtheyene urea at a concentration of about 5% applied to both sides of the mat by combination of spray nozzles and passing the mat between a pair of impregnation rollers. The loading level of the crosslinking agent was about 4.5% percent w/w. In this specific case, the rotor had a diameter of thirty inches, had sixteen rows of hammers about its circumference, and was rotated at an angular velocity of 1,200 rpm utilizing an electric motor 40. Other rpm rates have also been tested and have proven satisfactory, including extremely high rpm rates. Samples of fiberized fiber from the fiberizer were then removed and observed for nits. Over an extensive period of operation, 2.4 gram samples of the fibers were obtained from the outlet 15 to the fiberizer and were consistently observed to have three or fewer nits, with most samples having no nits present in the sample.

Although the fiberizer of the present invention is not limited to the processing of mats of cellulose fibers wetted with a crosslinking agent, further details of an apparatus used in processing such fibers is disclosed in U.S. patent application Ser. No. 601,268, entitled "Fiber Treatment Apparatus" to Allen R. Carney, et al. filed on Oct. 31, 1990.

Having illustrated and described the principles of our invention by what is presently a preferred embodiment thereof, it should be apparent to those persons skilled in the art that the illustrated embodiment may be modified without departing from such principles. For example, various arrangements of hammers and hammer mounting mechanisms may be utilized. We claim as our invention not only the illustrated embodiment, but all such modifications, variations and equivalents thereof as fall within the true spirit and scope of the following claims.

I claim:

1. A hammermill for fiberizing sheets or mats of fibers comprising:

a housing;

an elongated rotor within the housing and having first and second ends and a longitudinal axis of rotation, the rotor including a central shaft and plural hammers mounted thereto, the hammers having distal end surfaces forming an effective rotor surface upon rotation of the rotor about the axis of rotation;

means for rotating the central shaft to thereby rotate the hammers;

means for delivery of a mat to the hammers as the hammers are rotated; and first and second end plates mounted to the respective first and second ends of the rotor, the end plates projecting radially outwardly from the shaft to a location spaced further from the shaft than the distal end surfaces of the hammers, the end plates effectively directing air flow at the ends of the rotor, and resulting from rotation of the hammers, toward the center of the rotor to minimize the possibility of an accumulation of fibers at the ends of the rotor.

2. A hammermill for fiberizing sheets or mats of fibers, the hammermill comprising:

a housing;

an elongated rotor within the housing and having a longitudinal axis of rotation, the rotor including a plurality of hammers having distal end surfaces sweeping out an effective rotor surface upon rotation of the rotor about the axis of rotation, the distal end surfaces of the individual hammers upon such rotation sweeping separate cylindrical paths with gaps between the paths, the gaps between the paths not exceeding one-quarter of an inch, the rotor including an elongated central body, the hammers being mounted to the body with the hammers arranged in plural rows extending in a direction along the length of the body, each row including plural hammer populated regions, spaced apart by a hammer free or hammer unpopulated region, each hammer populated region comprising a stack of plural, spaced apart hammers projecting radially outward from the body, the gap between the individual hammers of the stack being no more than about one-quarter of an inch, and the hammer populated and hammer free regions being offset in the different rows such that at least one hammer populated region sweeps through each portion of the effective rotor surface upon rotation of the rotor, the rotor further including plural interior hammer mounting plates spaced inwardly from the respective ends of the central body, and first and second end mounting plates at the respective ends of the central body, the end mounting plates extending radially outward from the central body to a location which is beyond the radial outward most position of the distal end surfaces of the hammers, the end mounting plates directing airflow within the housing arising from the rotation of the rotor from the ends of the rotor toward the center of the rotor;

means for rotating the rotor about the axis of rotation to thereby rotate the hammers to provide the effective rotor surface; and the hammermill including at least one inlet through which a fiber mat is delivered to the effective rotor surface for fiberization by the rotating hammers, the housing defining an outlet located at an intermediate position corresponding to an intermediate portion of the effective rotor surface between the ends of the rotor, the outlet extending substantially the entire length of the housing.

3. The hammermill of claim 2 wherein the interior mounting plates each terminate at a location which is spaced radially inwardly from the effective rotor surface.

4. The hammermill of claim 2 wherein at least some of the hammers have an L-shaped cross section, with the hammermill further including a flushing conduit in communication with the interior of the housing for cleaning the hammermill.

5. A hammermill for fiberizing sheets or mats of fibers, the hammermill comprising a housing;

an elongated rotor within the housing and having a longitudinal axis of rotation, the rotor including multiple hammers having distal end surfaces arranged to sweep out an effective rotor surface upon rotation of the rotor about its axis, the hammers being positioned on the rotor with gaps between the distal end surfaces of respective hammers, the distal end surfaces of the individual hammers upon such rotation sweeping separate cylindrical paths, the rotor further including a pair of end plates mounted on the rotor, and positioned at opposite ends of the effective rotor surface, the end plates extending radially outward from the axis to a position beyond the effective rotor surface;

means for rotating the rotor about its axis such that the hammer ends provide the effective rotor surface; and the housing defining at least one mat inlet through which a fiber mat may be delivered to contact the effective rotor surface for fiberizing the mat.

6. The hammermill of claim 5 wherein each end plate has a first surface adjacent to the hammers and a second surface adjacent to the housing and terminates at a peripheral edge, the hammermill including an air flow path for delivering air to the second surface of each end plate, and the end plates are sufficiently solid that air flowing from the air flow path and from beyond the second surface of each said end plate must pass over the peripheral edge to reach the hammers.

7. The hammermill of claim 5 wherein the housing includes a housing end portion adjacent one of the end plates, said one of the end plates having a first surface adjacent to the hammers, the housing end portion defining an air inlet communicating with the flow path.

8. The hammermill of claim 5 wherein the housing includes opposite end portions, each end portion being adjacent one of the end plates and defining a respective air inlet.

9. The hammermill of claim 5 wherein the housing defines a pair of air inlets, and defines a fiber outlet positioned therebetween.

10. The hammermill of claim 9 wherein the inlets are sufficiently spaced apart that air may flow from the ends of the rotor toward a central portion of the rotor corresponding to the fiber outlet.

11. The hammermill of claim 5 wherein the housing includes a curved wall proximate the effective rotor surface, and wherein the curved wall defines with the end plate an annular airflow gap.

12. The hammermill of claim 11 wherein the airflow gap is between one-sixteenth and one-half of an inch and wherein there ar gaps between the paths swept by the hammers which gaps do not exceed one-fourth inch.

13. The hammermill of claim 5 wherein each of the hammers comprise a stack of first and second outer hammer plates with at least one interior hammer plate positioned between the first and second outer hammer plates.

14. The hammermill of claim 13 wherein the first and second outer hammer plates are of an L-shaped cross section.

15. The hammermill of claim 14 wherein the gaps between the paths swept by the hammers do not exceed one-fourth inch.

16. The hammermill of claim 15 in which the hammers comprise plural interior hammer plates positioned between the first and second outer hammer plates.

17. The hammermill of claim 15 in which adjacent hammer plates of each hammer have gaps between them which do not exceed one-fourth inch.

18. The hammermill of claim 15 including a flushing conduit in communication with the interior of the housing for cleaning the hammermill.

19. A hammermill for fiberizing sheets or mats of fibers, the hammermill comprising a housing;

an elongated rotor within the housing and having a longitudinal axis of rotation, the rotor including multiple hammers having distal end surfaces arranged to sweep out an effective rotor surface upon rotation of the rotor about its axis, the hammers being positioned on the rotor with gaps between the distal end surfaces of respective hammers, the distal end surfaces of the individual hammers upon such rotation sweeping separate cylindrical paths, the rotor further including a pair of air flow directing end plates mounted on the rotor, and positioned at opposite ends of the effective rotor surface, the end plates extending radially outward from the axis and terminating at a peripheral edge such that air flowing from beyond each end plate must pass over the peripheral edge to reach the center of the rotor;

means for rotating the rotor about its axis such that the hammer ends provide the effective rotor surface; and the housing defining at least one mat inlet through which a fiber mat may be delivered to contact the effective rotor surface for fiberizing the mat.

20. The hammermill of claim 19 wherein the end plates extend radially beyond the effective rotor surface.

21. The hammermill of claim 19 wherein the housing includes an end portion adjacent one of the end plates, the end portion defining an air inlet.

22. The hammermill of claim 19 wherein the housing includes opposite end portions, each end portion being adjacent one of the end plates and defining a respective air inlet.

23. The hammermill of claim 19 wherein the housing defines a pair of air inlets, and defines a fiber outlet positioned therebetween.

24. The hammermill of claim 23 wherein the inlets are sufficiently spaced apart that air flow from the ends of the rotor toward a central portion of the rotor corresponding to the fiber outlet.

25. The hammermill of claim 19 wherein the housing includes a curved wall proximate the effective rotor surface, and wherein the curved wall defines with the end plate an annular airflow gap.

26. The hammermill of claim 25 wherein the airflow gap is between one-sixteenth and one-half of an inch and wherein the gaps between the paths swept by the hammers do not exceed one-fourth inch.

27. The hammermill of claim 19 wherein each of the hammers comprise a stack of first and second outer hammer plates with at least one interior hammer plate positioned between the first and second outer hammer plates.

28. The hammermill of claim 27 wherein the first and second outer hammer plates are of an L-shaped cross section.

29. The hammermill of claim 28 wherein the gaps between the paths swept by the hammers do not exceed one-fourth inch.

30. The hammermill of claim 29 in which the hammers comprise plural interior hammer plates positioned between the first and second outer hammer plates.

31. The hammermill of claim 29 in which adjacent hammer plates of each hammer have gaps between them which do not exceed one-fourth inch.

* * * * *